US005799330A

United States Patent [19]

O'Donoghue-Kitt

[11] Patent Number: 5,799,330

[45] Date of Patent: Sep. 1, 1998

[54] MEDICAL TREATMENT GARMENT

[76] Inventor: Christine O'Donoghue-Kitt, 275 Nassau Ave., Manhasset, N.Y. 11030

[21] Appl. No.: 826,491

[22] Filed: Mar. 27, 1997

[51] Int. Cl.[6] ..... A41D 13/00

[52] U.S. Cl. ..... 2/114; 2/105; 2/69; 2/908

[58] Field of Search ..... 2/46, 48.1, 49.1, 2/49.2, 49.3, 49.4, 49.5, 50, 51, 52, 69, 73, 75, 80, 83, 105, 106, 104, 114, 115, 120, 121, 122

[56] References Cited

U.S. PATENT DOCUMENTS

| | | | |
|---|---|---|---|
| 1,489,046 | 4/1924 | Thompson | 2/114 |
| 2,690,564 | 10/1954 | Kingston et al. | 2/105 |
| 4,570,268 | 2/1986 | Freeman | 2/114 |
| 4,737,995 | 4/1988 | Wiley | 2/114 |
| 4,759,083 | 7/1988 | Belcher | 2/114 |
| 4,787,101 | 11/1988 | Feinberg | 2/114 |
| 4,920,578 | 5/1990 | Janzen et al. . | |
| 4,964,173 | 10/1990 | Gordon et al. . | |
| 5,097,535 | 3/1992 | Dye et al. | 2/114 |
| 5,097,536 | 3/1992 | Cohen | 2/114 |
| 5,133,086 | 7/1992 | Truitt et al. | 2/105 X |
| 5,228,141 | 7/1993 | Remsky et al. | 2/114 |
| 5,440,763 | 8/1995 | Shah et al. | 2/114 |

*Primary Examiner*—Jeanette E. Chapman
*Attorney, Agent, or Firm*—Collard & Roe, P.C.

[57] ABSTRACT

The invention comprises a patient garment having a front side, a back side and two sleeve sections. The front side opens vertically down the center and is closed with releasable fasteners such as buttons or snaps, to allow for the patient to put on the garment. The garment has four triangular openings, arranged two on the front side and two on the back side, with one each on the right and left sides of the garment. The garment has a shoulder strap on each side that runs from the neck of the garment along the shoulder line of the garment and connects to a sleeve section. The shoulder strap forms the top edge of each of the triangular openings. Four triangular panels are attached to the garment to cover each of the triangular openings. Each triangular panel has a top side, a proximal side and a distal side. The top side of each panel is releasably secured to a shoulder strap. The distal side of each panel is releasably secured to the garment, and the proximal side of the panel is permanently secured to the garment, to create a flap-like structure. Releasing the top and distal sides of a panel allows a health care professional to have access to parts of a patient's body without requiring removal of the garment.

5 Claims, 3 Drawing Sheets

MEDICAL TREATMENT GARMENT

BACKGROUND OF THE INVENTION

1. Field of the Invention

This invention relates to a medical treatment garment for use by patients in hospitals or during home nursing care. In particular, this invention relates to a garment having releasably secured flaps for allowing selective, limited access to a patient's body while wearing the garment, yet preserving the patient's modesty and comfort.

2. The Prior Art

Medical treatment garments are frequently worn during hospital stays or during medical procedures or examinations. These garments are typically made of thin cloth or paper, have short sleeves, an open back and can be secured shut only by a small string at the neck. Such a garment requires removal if a health care professional requires access to the front of a patient's body. These gowns compromise both a patient's comfort and modesty.

To offer an alternative to the traditional, hospital-issued medical gown, there have been many attempts to fashion a garment that would increase a patient's comfort and modesty. U.S. Pat. No. 5,440,763 discloses a medical gown having several large panels which can be released from the body of the gown to open up a portion of the body for examination. The gown is sleeveless and is held together by many releasable closures to permit access to the patient's body. However, the gown does not have means for opening at the back to perform any examination of the patient's back. Furthermore, the structure of the prior art garment is such that opening any of the panels compromises the structural integrity of the gown.

Another garment of this type is disclosed in U.S. Pat. No. 4,920,578, which shows a patient's gown having a front panel that can be opened to expose a portion of the front of the patient. The gown also has a longitudinal opening in the back for allowing the gown to be put on a patient. Again, opening the panel in the front of the garment compromises the structural integrity of the garment. Furthermore, this garment does not allow for access to a portion of the patent's back while still covering most of the patient's body.

U.S. Pat. No. 4,964,173 to Gordon et al. discloses a gown that has detachable portions for allowing selective access to a patient. This garment uses Velcro to secure the various portions together. The problem with this type of fastener is that it does not withstand numerous washings. In addition, this gown is cumbersome, and many users would require assistance in putting on the gown.

Other examples of medical garments are disclosed in U.S. Pat. No. 5,133,086 and U.S. Pat. No. 5,097,536. These garments also have panels and seams that allow for access to a patient's body. However, like the other prior art patents, opening the seams for examining a patient causes the garment to sag and/or slip off of a patient.

SUMMARY OF THE INVENTION

It is therefore an object of the present invention to overcome the drawbacks of the prior art and to provide a patient garment having panels that can be opened for selective access to both the front and back of a patient's body.

It is another object of the present invention to provide a patient garment in which opening of one or more of the panels does not compromise the structural integrity of the garment.

It is a further object of the present invention to provide a patient garment having sleeves that can be selectively opened to allow for access to a patient's arms.

It is yet another object of the present invention to provide a patient garment that is warm and comfortable, yet durable and economical to manufacture.

The invention comprises a patient garment having a front side, a back side and two sleeve sections. The front side opens vertically down the center and is closed with releasable fasteners such as buttons or snaps, to allow for the patient to put on the garment. The garment has four triangular openings, arranged two on the front side and two on the back side, with one each on the right and left sides of the garment. The openings allow for access to the patient's chest area and back area for examination without removing the garment. Each opening has a top edge, a proximal edge and a distal edge. The garment has a shoulder strap on each side that runs from the neck of the garment along the shoulder line of the garment and connects to a sleeve section. The shoulder strap forms the top edge of each of the triangular openings.

Four triangular panels are attached to the garment to cover each of the triangular openings. Each triangular panel has a top side, a proximal side and a distal side. The top side of each panel is releasably secured to a shoulder strap. The distal side of each panel is releasably secured to the garment, and the proximal side of the panel is permanently secured to the garment, to create a flap-like structure.

Releasing the top and distal sides of a panel allows a health care professional to have access to parts of a patient's body without requiring removal of the garment. The specific configuration of the triangular openings and the releasable securing of the triangular panels to the shoulder straps allows for opening of one or more of the panels without affecting the structure of the garment. In fact, all four of the triangular panels could be opened at one time without affecting the structural integrity of the garment. The garment is kept intact by means of the shoulder straps, which are permanently affixed to the garment and keep the garment on a patient, even when all of the triangular panels are opened.

In addition, the garment has sleeve sections that are releasably secured together with fasteners as well. Releasing the sleeve fasteners allows a health care worker to have access to the patient's arms, for such procedures as phlebotomy and blood pressure measurements.

The releasable panels are preferably secured to the garment with buttons, however other means such as velcro, snaps, or hooks could also be used. The garment is preferably made from a durable, yet comfortable fabric, such as cotton/polyester blend, or triacetate. The garment could be configured either as a shirt, ending at the patient's waist, or as a gown or nightshirt, extending to the patient's knees or below.

The garment could be made having either short sleeves or long sleeves. In the case of short sleeves, a single button closure is sufficient to keep the front and back sleeve sections together. With a long sleeved garment, two or more buttons or other fasteners should be used.

There are preferably at least two pockets located on the garment, either in the form of slit pockets at the side seams of the garment, or as patch pockets located directly below the front triangular flaps. Other types and locations for the pockets could also be envisioned. The pockets should be of sufficient size to hold tissues, medicine and portable intravenous administration devices.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
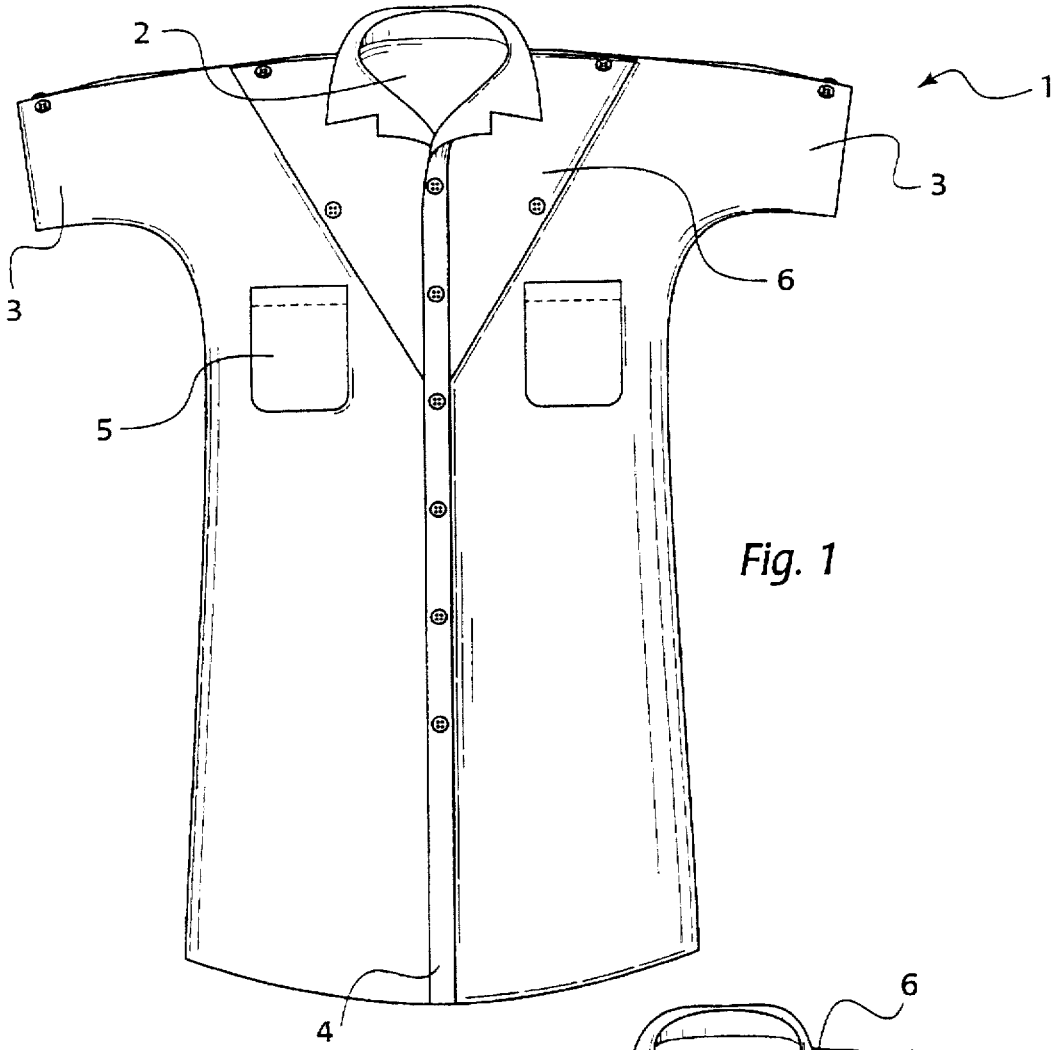
FIG. 1 is a front view of the garment according to the invention.

Referring now in detail to the drawings and, in particular, FIG. 1, there is shown a front view of a medical treatment garment 1, having a neck opening 2, two sleeve sections 3 and a front opening 4. Front opening 4 is preferably secured by buttons, but velcro, snaps, hooks or zippers could also be used. Two triangular panels 6 are sewn to garment 1 along front opening 4. The other two sides of each panel 6 is releasably secured to garment 1, preferably with buttons.

Two pockets 5 are attached immediately below panels 6 on either side of the garment. Pockets 5 are placed to allow for easy access by the wearer to medication, tissues and other items, but will not allow the contents to spill when the patient sits down or during a medical examination.

Figure 2:
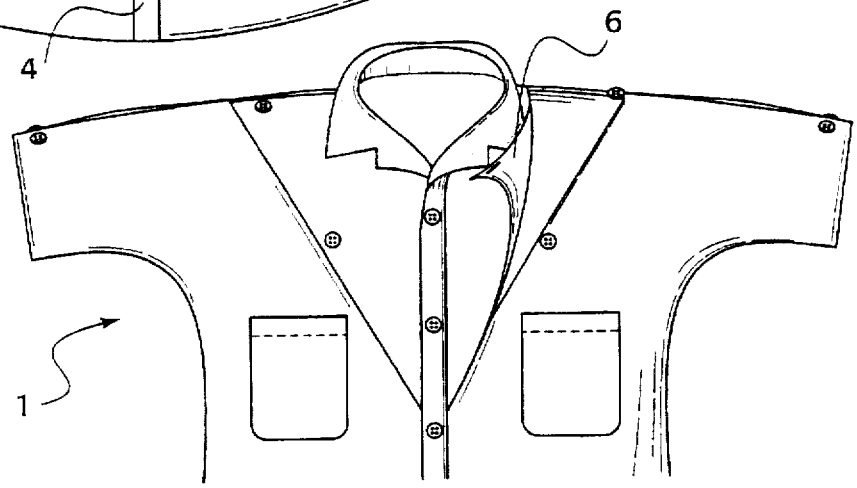
FIG. 2 is a front view of the garment according to FIG. 1 with one triangular panel opened.

As shown in FIG. 2, releasing the two free sides of panel 6 allows for access into garment 1 to examine a portion of a patient's body. The opening of any one or both of panels 6 does not affect the structure of the garment on the patient. In other words, the opening of any of the panels on garment 1 does not enable the garment to fall off the patient or reveal parts of the patient's body other than those immediately underneath the open panels.

Figure 3:
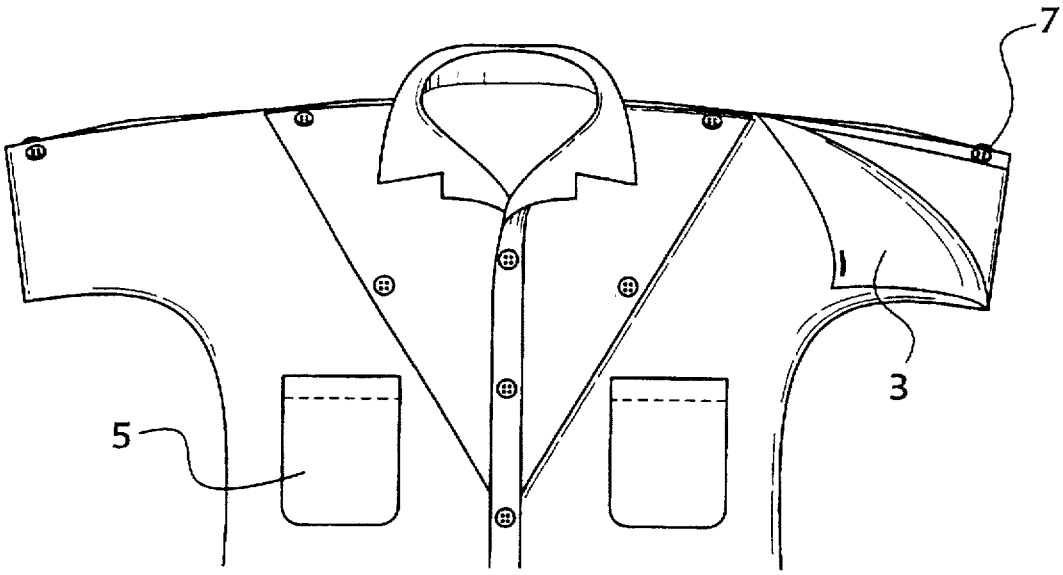
FIG. 3 is a front view of the garment according to FIG. 1 with the sleeve opened.

FIG. 3 shows how sleeve sections 3 also can be opened to access the patient's arms. Sleeve sections 3 are open along their top end and are releasably secured shut with fasteners, preferably buttons 7. This way, sleeve sections 3 keep a patient's arms warm but also allow for selective access to their arms.

Figure 4:
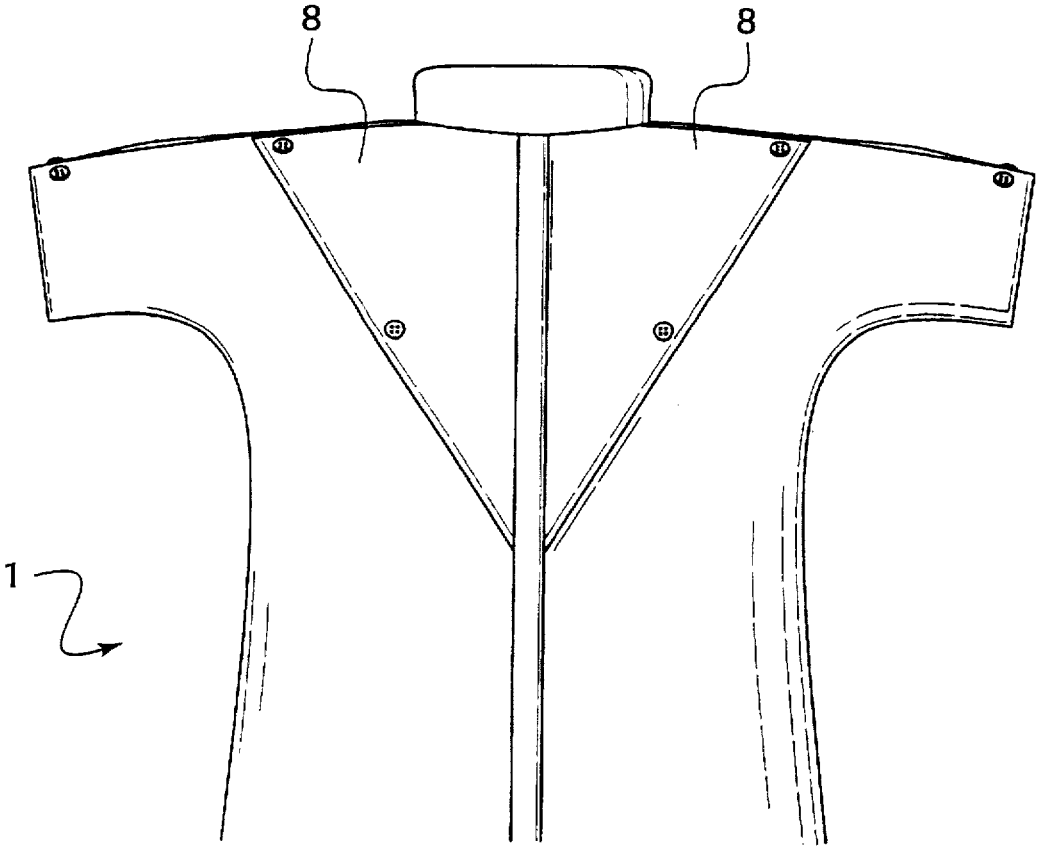
FIG. 4 is a back view of the garment according to the invention.
Figure 5:
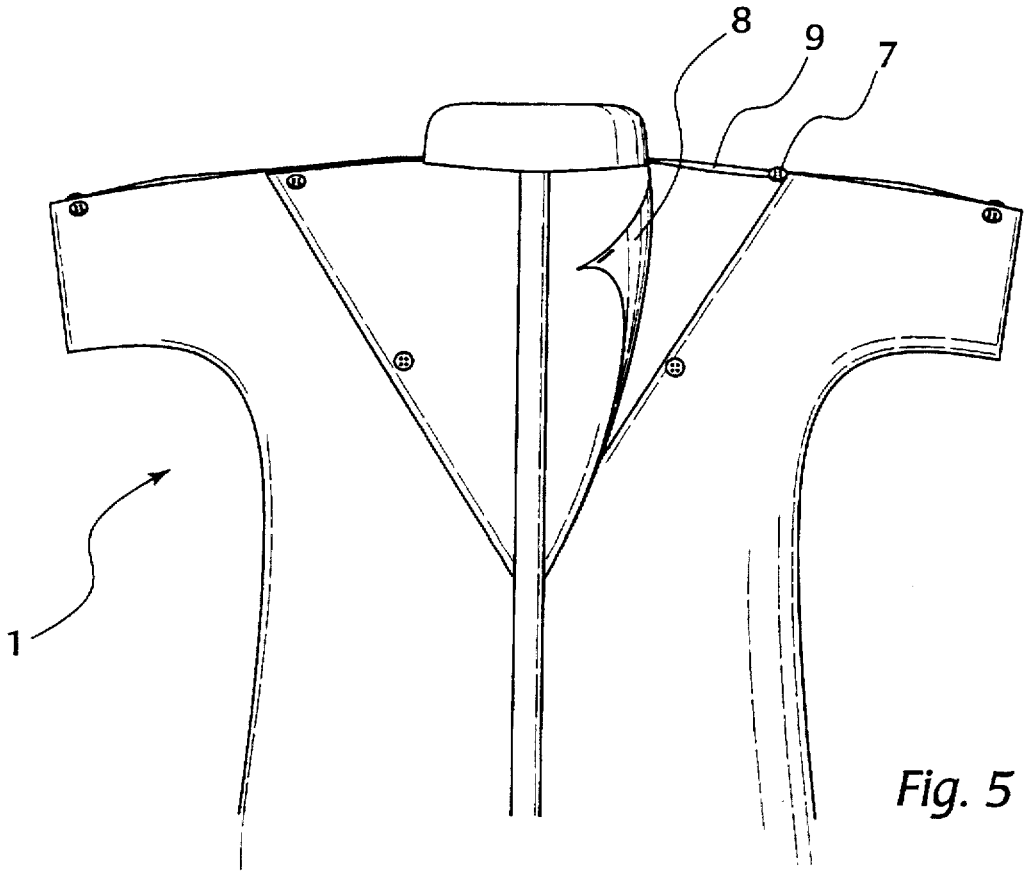
FIG. 5 is a back view of the garment according to FIG. 4 with a triangular panel opened.
Figure 6:
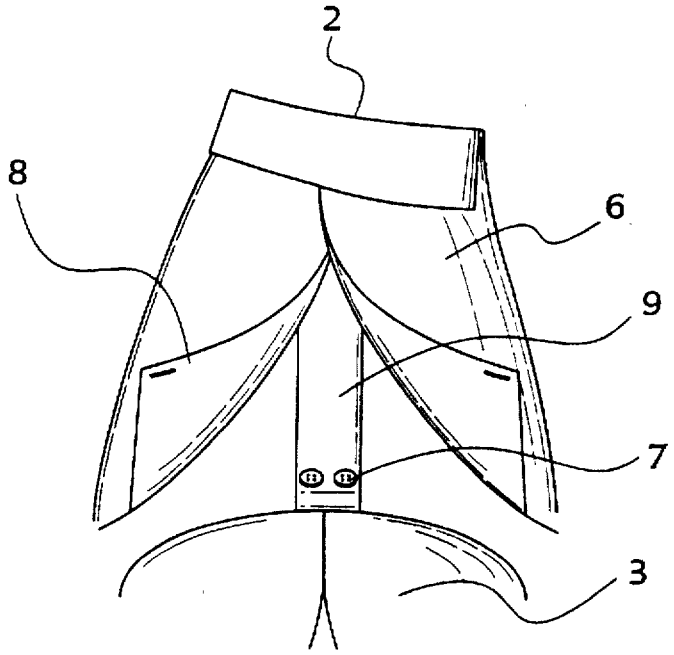
FIG. 6 is a side view of the garment according to the invention, showing the shoulder strap and the back and front triangular panels opened.

FIG. 4 shows a rear view of garment 1. Garment 1 also has two rear triangular panels 8, which., as shown in FIG. 5, operate in the same way as front triangular panels 6. Triangular panels 8 and 6 are releasably attached to garment 1 by a shoulder strap 9. Shoulder strap 9 has two buttons, each button releasably connecting one panel to shoulder strap 9, as shown in FIG. 6.

Shoulder strap 9 connects neck opening 2 with sleeve section 3 and keeps garment 1 intact when triangular panels 6 and 8 are opened. This way, all four triangular panels could be opened at once without affecting the structural integrity of garment 1.

Accordingly, while only several embodiments of the present invention have been shown and described, it is obvious that many changes and modifications may be made thereunto without departing from the spirit and scope of the invention.

What is claimed is:

1. A medical treatment garment, comprising:

a front side having a left side and a right side, said left and right sides being releasably attached to each other down a center of the front side to allow the garment to open and a patient to put on the garment;

a back side having a right side and a left side, said back left side being attached to the front left side and the back right side being attached to the front right side, to create a garment having a neck opening, a bottom opening and two arm openings, wherein said front side and said back side each have left and right triangular openings, so that the patient's chest area and back are accessible through said triangular openings, and wherein each triangular opening is bordered by a top edge, a proximal edge and a distal edge;

a left sleeve section and a right sleeve section, each of said right and left sleeve sections having a front side and a back side;

a left shoulder strap and a right shoulder strap, each strap having a first end connected to the garment at the neck opening and a second end connected to a sleeve section, wherein said left and right shoulder straps form top edges of the triangular openings on the front and back sides;

a left front triangular panel and a right front triangular panel, the left front triangular panel attached to the left front side of the garment along the proximal edge of the left front opening, said left front triangular panel covering the left front triangular opening and being releasably connected to the left shoulder strap near the second end and to the distal edge of the right front triangular opening, and the right front triangular panel being attached to the right front side along the proximal edge of the right front triangular opening, said right front triangular panel covering the right front triangular opening and being releasably connected to the right shoulder strap near the second end and to the right front side at the distal edge of the right front triangular opening;

a left back triangular panel and a right back triangular panel, the left back triangular panel being attached to the left back side along the proximal edge of the left back triangular opening, said left back triangular panel covering the left back triangular opening and being releasably connected to the left shoulder strap near the second end and to the left back side along the distal edge of the left back triangular opening, and the right back triangular panel being attached to the right back side along the proximal edge of the right back triangular opening, said right back triangular panel covering the right back triangular opening and being releasably connected to the right shoulder strap near the second end and to the right back side at the distal edge of the right back triangular opening, such that two sides of one or more of the triangular panels can be detached from the garment to allow access to portions of a patient's body without affecting the structure of the garment.

2. The garment of claim 1, further comprising patch style pockets located one each on the right front side and left front side, said pockets being attached immediately below the triangular panels.

3. The garment of claim 1, further comprising slit-type pockets located one on each of the right side and left side of the garment.

4. The garment of claim 1, wherein the front side and back side of each of the sleeve sections are releasably connected, so that unconnecting the front side and back side of the sleeve sections allows access to the patient's arm.

5. The garment of claim 1, wherein each of the releasable connections are formed by buttons and button holes.

* * * * *